US009723909B2

(12) United States Patent
Alcantra et al.

(10) Patent No.: US 9,723,909 B2
(45) **Date of Patent: *Aug. 8, 2017**

(54) HEXAGONAL ATTACHMENT SYSTEM

(71) Applicant: 5.11, Inc., Irvine, CA (US)

(72) Inventors: Cres Trilles Alcantra, San Ramon, CA (US); Fernando Calderon Aguilar, Santa Ana, CA (US); Scott Michael Lambert, Irvine, CA (US)

(73) Assignee: 5.11, INC., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/428,044

(22) Filed: Feb. 8, 2017

(65) Prior Publication Data

US 2017/0143107 A1 May 25, 2017

Related U.S. Application Data

(63) Continuation of application No. 14/454,641, filed on Aug. 7, 2014, now Pat. No. 9,664,481.

(51) Int. Cl.

| | |
|---|---|
| ***A45F 5/02*** | (2006.01) |
| ***A45F 3/14*** | (2006.01) |
| ***A41D 1/04*** | (2006.01) |
| ***A41D 3/00*** | (2006.01) |
| ***A41D 1/06*** | (2006.01) |
| ***A41B 1/08*** | (2006.01) |
| ***A41C 1/12*** | (2006.01) |

(Continued)

(52) U.S. Cl.

CPC ..... *A45F 5/02* (2013.01); *A41B 1/08* (2013.01); *A41C 1/12* (2013.01); *A41D 1/04* (2013.01); *A41D 1/06* (2013.01); *A41D 3/00* (2013.01); *A41D 27/00* (2013.01); *A45F 3/14* (2013.01); *F41C 33/041* (2013.01); *F41C 33/046* (2013.01); *A45F 2003/146* (2013.01)

(58) Field of Classification Search

None

See application file for complete search history.

(56) References Cited

U.S. PATENT DOCUMENTS

| | | | |
|---|---|---|---|
| 833,546 | A | 10/1906 | Pierce |
| 2,001,508 | A | 5/1935 | Tobin |
| 2,663,419 | A | 12/1953 | Velman et al. |

(Continued)

FOREIGN PATENT DOCUMENTS

| | | |
|---|---|---|
| WO | 0193710 | 12/2001 |
| WO | 2009151643 | 12/2009 |

(Continued)

OTHER PUBLICATIONS

U.S. Appl. No. 14/454,641, "Non-Final Office Action", Apr. 8, 2016, 22 pages.

(Continued)

*Primary Examiner* — Justin Larson
*Assistant Examiner* — Phillip Schmidt
(74) *Attorney, Agent, or Firm* — Kilpatrick Townsend & Stockton LLP

(57) ABSTRACT

An attachment system can include a plurality of apertures or openings in an attachment platform. The openings can be arranged in a pattern corresponding to a hexagon so that an attachment member for a MOLLE-compatible accessory may be passed through one or more of the openings so as to attach the accessory in a variety of different directions.

20 Claims, 6 Drawing Sheets

(51) Int. Cl.
*A41D 27/00* (2006.01)
*F41C 33/04* (2006.01)

(56) References Cited

U.S. PATENT DOCUMENTS

| | | | |
|---|---|---|---|
| 4,272,847 | A | 6/1981 | Buhler |
| 4,319,422 | A | 3/1982 | Robins et al. |
| 4,373,211 | A | 2/1983 | Goudreau et al. |
| 4,413,357 | A | 11/1983 | Sacks |
| 4,422,183 | A | 12/1983 | Landi et al. |
| 4,993,076 | A | 2/1991 | Dierickx |
| 5,185,195 | A | 2/1993 | Harpell et al. |
| 5,255,930 | A | 10/1993 | Wright et al. |
| 5,724,707 | A | 3/1998 | Kirk et al. |
| 6,108,816 | A | 8/2000 | Bradley |
| 6,370,690 | B1 | 4/2002 | Neal et al. |
| 6,519,782 | B2 | 2/2003 | Collins et al. |
| 6,823,566 | B2 | 11/2004 | Coffey |
| 7,047,570 | B2 | 5/2006 | Johnson |
| 7,200,871 | B1 | 4/2007 | Carlson |
| 7,526,842 | B2 | 5/2009 | Wemmer |
| 7,644,449 | B2 | 1/2010 | Hellweg |
| 7,845,527 | B1 | 12/2010 | McMillan et al. |
| 7,917,968 | B2 | 4/2011 | Roux |
| 8,002,159 | B2 | 8/2011 | Cragg |
| 8,079,503 | B1 | 12/2011 | Yeates et al. |
| 8,209,769 | B1 | 7/2012 | Ellis et al. |
| 8,365,312 | B2 | 2/2013 | Herring |
| 8,453,899 | B1 | 6/2013 | Calkin et al. |
| 8,490,213 | B2 | 7/2013 | Neal |
| 8,608,041 | B1 | 12/2013 | Adkisson |
| 8,613,157 | B2 | 12/2013 | McCaffery et al. |
| 8,776,291 | B1 | 7/2014 | Lewis |
| 8,814,019 | B2 | 8/2014 | Patulski et al. |
| 2003/0101508 | A1 | 6/2003 | Marshall et al. |
| 2005/0109911 | A1 | 5/2005 | Bigelow et al. |
| 2006/0002740 | A1 | 1/2006 | Tanaka et al. |
| 2006/0162135 | A1 | 7/2006 | Howell et al. |
| 2006/0191049 | A1 | 8/2006 | Elkins et al. |
| 2006/0191110 | A1 | 8/2006 | Howell et al. |
| 2006/0211000 | A1 | 9/2006 | Sorge et al. |
| 2006/0242799 | A1 | 11/2006 | Flossner et al. |
| 2007/0242844 | A1 | 10/2007 | Harman et al. |
| 2007/0289045 | A1 | 12/2007 | Evans et al. |
| 2008/0154164 | A1 | 6/2008 | Sheehan et al. |
| 2009/0071561 | A1 | 3/2009 | Dalrymple et al. |
| 2009/0117300 | A1 | 5/2009 | Thompson |
| 2009/0149875 | A1 | 6/2009 | Abele et al. |
| 2009/0282595 | A1 | 11/2009 | Branson et al. |
| 2009/0307878 | A1 | 12/2009 | Kadas |
| 2010/0025560 | A1 | 2/2010 | Beck |
| 2010/0103509 | A1 | 4/2010 | Robinson et al. |
| 2010/0110664 | A1 | 5/2010 | Cho et al. |
| 2010/0224660 | A1 | 9/2010 | Gleason et al. |
| 2011/0100899 | A1 | 5/2011 | Hawkins et al. |
| 2011/0191933 | A1 | 8/2011 | Gregory et al. |
| 2011/0204114 | A1 | 8/2011 | Miller et al. |
| 2011/0278339 | A1 | 11/2011 | Hexels et al. |
| 2011/0302686 | A1 | 12/2011 | Chapuis et al. |
| 2012/0017347 | A1 | 1/2012 | Strum et al. |
| 2012/0024924 | A1 | 2/2012 | Hexels et al. |
| 2012/0036742 | A1 | 2/2012 | Sutton et al. |
| 2012/0175390 | A1 | 7/2012 | Rogers et al. |
| 2012/0175391 | A1 | 7/2012 | Rogers et al. |
| 2012/0180189 | A1 | 7/2012 | Crye |
| 2012/0237775 | A1 | 9/2012 | Kosugi et al. |
| 2012/0318837 | A1 | 12/2012 | Yaeger et al. |
| 2012/0325836 | A1 | 12/2012 | Nenninger et al. |
| 2013/0047386 | A1 | 2/2013 | Barfoot et al. |
| 2013/0086772 | A1 | 4/2013 | Raymond et al. |
| 2013/0126566 | A1 | 5/2013 | Seuk et al. |
| 2013/0181019 | A1 | 7/2013 | Salentine et al. |
| 2013/0193179 | A1 | 8/2013 | Davidson et al. |
| 2013/0240588 | A1 | 9/2013 | Milligan et al. |
| 2013/0256498 | A1 | 10/2013 | Antonioni et al. |
| 2013/0292430 | A1 | 11/2013 | Seuk et al. |
| 2014/0014700 | A1 | 1/2014 | Gill et al. |
| 2014/0090145 | A1 | 4/2014 | Strum et al. |
| 2014/0150161 | A1 | 6/2014 | Nykoluk |
| 2014/0151424 | A1 | 6/2014 | Hexels et al. |
| 2014/0234573 | A1 | 8/2014 | Lindgren et al. |
| 2014/0263519 | A1 | 9/2014 | Saucedo et al. |
| 2014/0305937 | A1 | 10/2014 | Fordham et al. |
| 2014/0361058 | A1 | 12/2014 | Gill et al. |
| 2015/0041512 | A1 | 2/2015 | Rief et al. |
| 2015/0090751 | A1 | 4/2015 | Langford et al. |
| 2015/0157117 | A1 | 6/2015 | Seuk et al. |
| 2015/0201761 | A1 | 7/2015 | Wollenberg |
| 2015/0257458 | A1 | 9/2015 | Nykoluk et al. |
| 2016/0040958 | A1 | 2/2016 | Alcantra et al. |

FOREIGN PATENT DOCUMENTS

| | | |
|---|---|---|
| WO | 2010046664 | 4/2010 |
| WO | 2013022976 | 2/2013 |
| WO | 2013096110 | 6/2013 |
| WO | 2014063969 | 5/2014 |
| WO | 2016022838 | 2/2016 |

OTHER PUBLICATIONS

U.S. Appl. No. 14/454,641, "Non-Final Office Action", Aug. 24, 2016, 27 pages.

U.S. Appl. No. 14/454,641, "Notice of Allowance", Jan. 25, 2017, 5 pages.

F.A.S.T. Vest, Vermont's Barre Army Navy, Jun. 2013.

PCT/US2015/044072, "International Search Report and Written Opinion", Oct. 13, 2015, 10 pages.

Voodoo Tactical, "Voodoo Tactical Variable Advanced Assault Tactical Plate Carrier Vest", Retrieved from the Internet: <URL: http://www.voodootactical.net/p-999-voodoo-tactical variable-advanced- assault-tactical-plate-carrier-vest-vaat.aspx>, [retrieved on Aug. 14, 2014], May 2013.

U.S. Design U.S. Appl. No. 29/566,082, "Attachment Platform," filed May 26, 2016.

U.S. Appl. No. 15/410,314, Attachment System with Reinforcing Coating, filed Jan. 19, 2017.

HEXAGONAL ATTACHMENT SYSTEM

CROSS-REFERENCES TO RELATED APPLICATIONS

This application is a continuation of U.S. patent application Ser. No. 14/454,641, filed Aug. 7, 2014, the entire contents of which is hereby incorporated by reference in its entirety.

BACKGROUND

Equipment, especially that used in tactical scenarios, can be attached to a garment on an individual or other equipment in a number of ways. MOLLE (Modular Lightweight Load-carrying Equipment) is load-bearing equipment and rucksacks utilized by the United States armed forces. The MOLLE system is modular and permits the attachment of various MOLLE-compatible accessories, such as holsters, magazine pouches, radio pouches, knife sheathes, and other gear to MOLLE-compatible load-bearing garments, such as vests, backpacks, and jackets.

The MOLLE system's modularity is derived from the use of web platforms on load-bearing garments. For example, PALS (Pouch Attachment Ladder System) web platforms can be included on the load-bearing garments. PALS webbing includes rows of heavy-duty nylon stitched onto the vest or other load-bearing garment so as to allow for attachment of MOLLE-compatible accessories.

PALS webbing is attached to load-bearing garments in a grid structure. The PALS grid consists of horizontal rows of 1 inch (2.54 centimeters) nylon webbing (most commercial vendors use Type Ma), spaced 1 inch (2.54 centimeters) apart, and reattached, typically via stitching, to the backing at 1.5 inch (3.81 centimeters) intervals. This consistent reattachment forms, for each strap, a series of upwardly and downwardly opened loops. The loops for adjacent straps are aligned so that a series of loops are stacked one on top of each other. This pattern provides secure and stable attachment for MOLLE accessories. As such, PALS structures and other objects that can provide secure and stable attachment for MOLLE accessories are generally collectively termed MOLLE attachment systems.

The following references may be relevant to this technology: U.S. Pat. Nos. 5,185,195, 5,724,707, 7,047,570, 7,200,871, 7,526,842, 7,644,449, 7,917,968, 8,002,159, 8,079,503, 8,365,312, 8,490,213, U.S. Patent Publication No. 2007/0289045, U.S. Patent Publication No. 2009/0117300, U.S. Patent Publication No. 2010/0025560, U.S. Patent Publication No. 2012/0180189, U.S. Patent Publication No. 2013/0126566, U.S. Patent Publication No. 2013/0256498, Patent Cooperation Treaty Publication No. WO 2013/096110, Patent Cooperation Treaty Publication No. WO 2013/022976, Patent Cooperation Treaty Publication No WO 2010/046664, and Patent Cooperation Treaty Publication No. WO 2009/151643.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with embodiments, a mounting system is provided having a load-bearing platform and a hexagonal substrate. The load-bearing platform includes at least a portion of a garment or a pack. The hexagonal substrate includes an attachment platform connected to the load-bearing platform. The hexagonal substrate further includes a plurality of hexagonal openings formed in the attachment platform. The hexagonal openings are arranged in a repeating hexagonal pattern configured to facilitate attachment of MOLLE-compatible accessories to the attachment platform along any of at least three differing axes.

Additional embodiments are directed to a hexagonal substrate for a system configured to attach equipment to a wearable load-bearing platform. The hexagonal substrate includes an attachment platform configured for connection with the load-bearing platform. The hexagonal substrate further includes a plurality of openings formed in the attachment platform and arranged in a repeating hexagonal pattern configured to facilitate attachment of MOLLE-compatible accessories to the attachment platform along any of at least three differing axes.

For a fuller understanding of the nature and advantages of the present invention, reference should be made to the ensuing detailed description and accompanying drawings.

BRIEF DESCRIPTION OF THE DRAWINGS

Various embodiments in accordance with the present disclosure will be described with reference to the drawings, in which.

DETAILED DESCRIPTION OF THE INVENTION

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Figure 1:
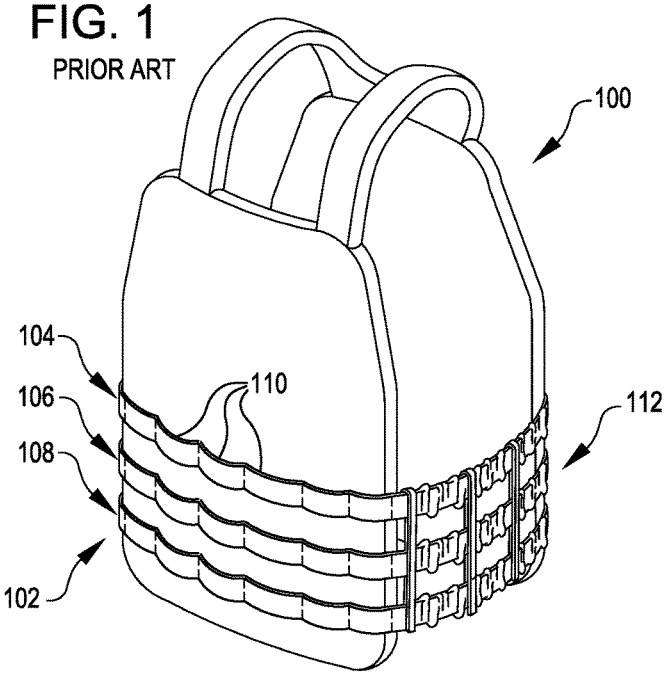
FIG. 1 PRIOR ART
FIG. 1 illustrates a vest outfitted with known MOLLE attachment systems.

Embodiments herein are directed to attachment systems. Referring now to the drawings, in which features that are identified by differing reference numerals across different drawings but share common names in the description herein may refer to features that may or may not differ across embodiments, FIG. 1 illustrates a vest 100 having known attachment systems 102 and 112.

A traditional MOLLE attachment system 102 can include a plurality of rows 104, 106, and 108, each including a number of loops 110. The loops 110 are commonly formed by webbing stitched down at regular intervals. For example, in a commonly used configuration, stitching is placed so that loops 110 have a width just over 1 inch (2.54 centimeters) so as to be configured to receive or accommodate attachment members up to 1 inch (2.54 centimeters) in width. Attachment members can be passed through loops 110 of successive rows 104, 106, and/or 108 to hold equipment or objects with respect to the vest 100. As may be appreciated, one limitation of such a traditional MOLLE attachment system 102 is that equipment can only be attached in a single orientation, even though the object can be attached at various locations on the vest 100 using the attachment system 102.

Other existing attachment systems can allow MOLLE-compatible items to be attached in either a vertical or a horizontal orientation. For example, the attachment system 112 includes a stretchable web platform that can facilitate such attachment and is described more fully in U.S. Non-Provisional patent application Ser. No. 14/094,583, entitled "GARMENT WITH CARRYING SYSTEM," filed Dec. 2, 2013 (Attorney Docket No. 93168-888229), which claims the benefit of U.S. Provisional Application No. 61/732,165 (Attorney Docket No. 93168-831642 (001200US)), filed on Nov. 30, 2012, the entire disclosures of which are hereby incorporated herein by reference. In either attachment system 102 or 112 depicted in FIG. 1, MOLLE-compatible items may be attached by hooking or weaving a feature of the item into the structure of the attachment system 102 or 112.

Figure 2:
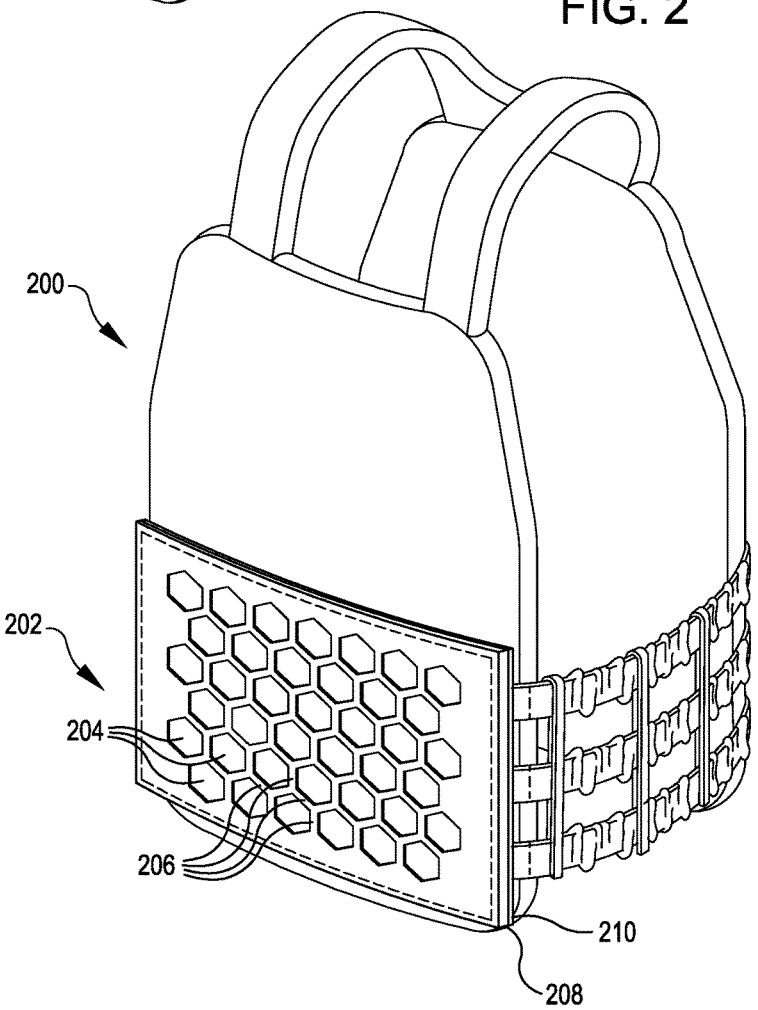
FIG. 2 illustrates a vest outfitted with a hexagonal attachment system according to an embodiment.

FIG. 2 illustrates an example of a vest 200 having a hexagonal attachment system 202. The hexagonal attachment system 202 can provide a greater number of attachment orientations than known attachment systems, such as the attachment systems 102 or 112. The hexagonal attachment system 202 can include an attachment platform 208 having a plurality of apertures or openings 204. The openings 204 can be hexagonally shaped and/or arranged in a hexagonal network, as is discussed in greater detail below with reference to FIG. 5. As such, the attachment platform 208 can provide a number of different options for orientation of items attached via the openings 204 of the attachment platform 208.

In some embodiments, the openings 204 can be separated by a plurality of links 206. Any suitable manner of forming the network of openings 204 and links 206 may be utilized, including, but not limited to, cutting the openings 204 in a material or weaving portions of a material to form links 206 that define boundaries of the openings 204. The openings 204 can be arranged so that an attachment member (such as a hook, portion of webbing, or strip of rigid or semi-rigid material) may be passed through a number of the openings 204 (e.g., over and/or under a number of links 206) so as to attach equipment or gear to the vest 200.

Furthermore, although the hexagonal attachment system 202 is described in relation to a vest 200 with respect to FIG. 2 and elsewhere herein, any load-bearing platform may form an appropriate foundation for the hexagonal attachment system 202. Non-limiting examples of load-bearing platforms with which hexagonal attachment system 202 may be utilized include any suitable portion of a garment, clothing, pants, a shirt, a jacket, a vest, a girdle, a pack, a pouch, a holster, a sheath, an ammunition clip, gear, equipment, and/or an accessory thereof.

The attachment platform 208 can be attached, connected, or integral with the vest 200. In some aspects, the attachment platform 208 can be connected to a backing structure 210 at positions between openings (such as described in greater detail below with respect to the connections 560 and 562 depicted in FIG. 5). In alternative aspects, the attachment platform 208 may be connected to the backing structure 210 without connections between openings 208 (such as by the stitching solely about a perimeter of the attachment platform 208 depicted in FIG. 2). Although the backing structure 210 is depicted in FIG. 2 as a separate interposed and attached piece between the vest 200 and the attachment platform 208, in some aspects, the backing structure 210 may be an integral portion of the vest 200. In some embodiments, the openings 204 are formed directly in the material of the vest 200 and the backing structure 210 is not present. In some embodiments, neither the vest 200 nor the backing structure 210 is present, and the openings 204 are formed directly in a stand-alone attachment platform 208 (see for example FIGS. 6-11).

Any suitable material or combination of materials can be used in the hexagonal attachment system 202. For example, the attachment platform 208 and/or the backing structure 210 can include any suitable load-bearing material, including, but not limited to, nylon, rubber, and extruded polymers. Furthermore, the attachment platform 208 and/or the backing structure 210 can include any substrate formed of any single-layer or multi-layer construction.

Figure 3:
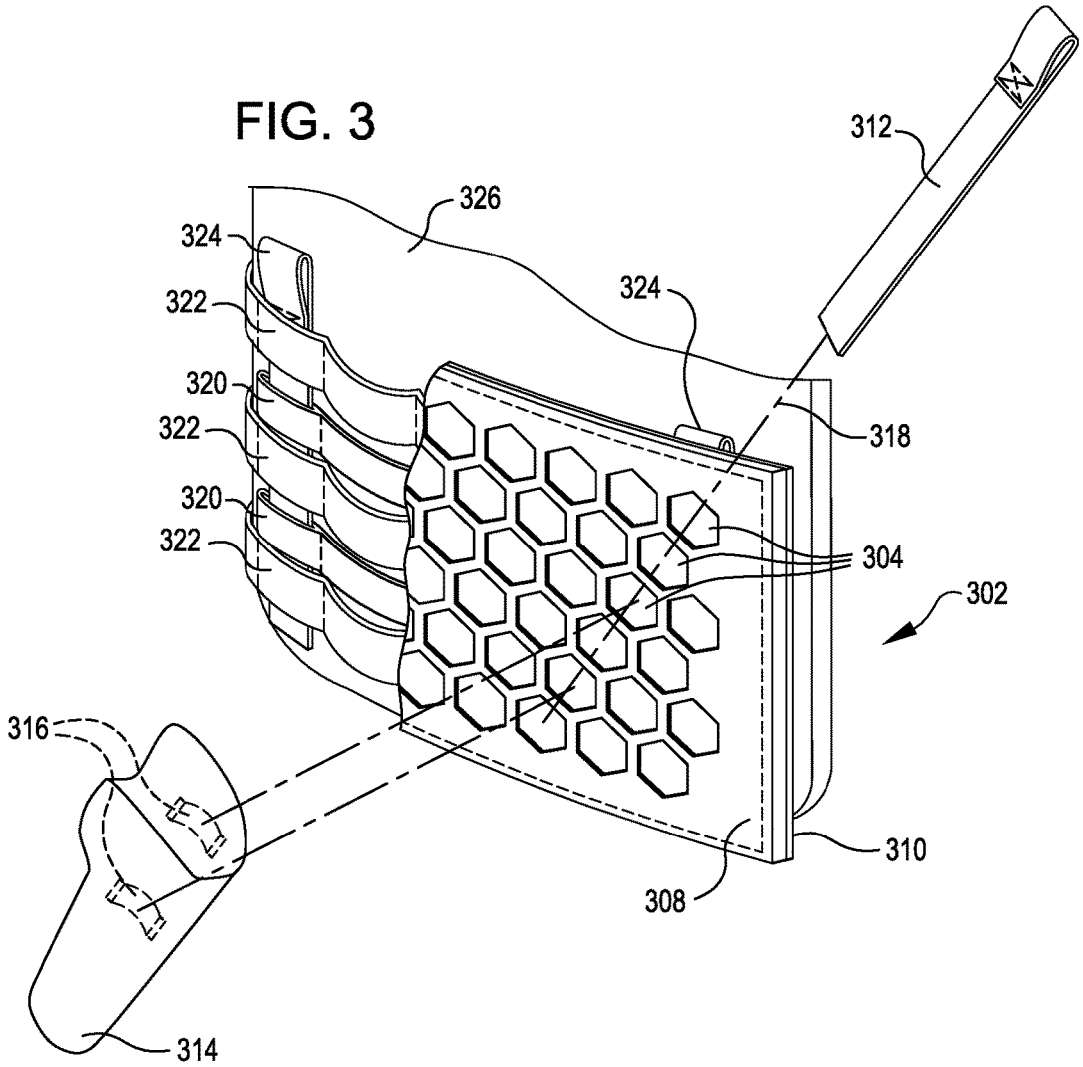
FIG. 3 illustrates mounting equipment to a hexagonal attachment system according to an embodiment.

The attachment platform 208 and/or backing structure 210 can be connected to the vest 200 by any suitable mechanism, including, but not limited to, stitching, hook and loop fasteners, bonding, or fusing. FIG. 3 illustrates a further example of a way in which a hexagonal attachment system 302 may be connected to a surface 326. For example, the surface 326 may be a portion of the vest 100, and the hexagonal attachment system 302 may attach to a known MOLLE-compatible attachment system 102 or 112 to retrofit the vest 100. An attachment platform 308 containing openings 304 of the hexagonal attachment system 302 may be affixed to a front side of a backing structure 310, such as by stitching about a perimeter of the attachment platform 308. A first set of loops 320 may be attached to a rear side of the backing structure 310. The first set of loops 320 may align with a second set of loops 322 mounted to the surface 326. An attachment member 324 can be alternatingly passed through the first set of loops 320 and the second set of loops 322 to attach the backing structure 310 to the surface 326. In some aspects, additional hexagonal attachment systems 302 can be utilized in place of either or both of the first set of loops 320 or the second set of loops 322.

Figure 4:
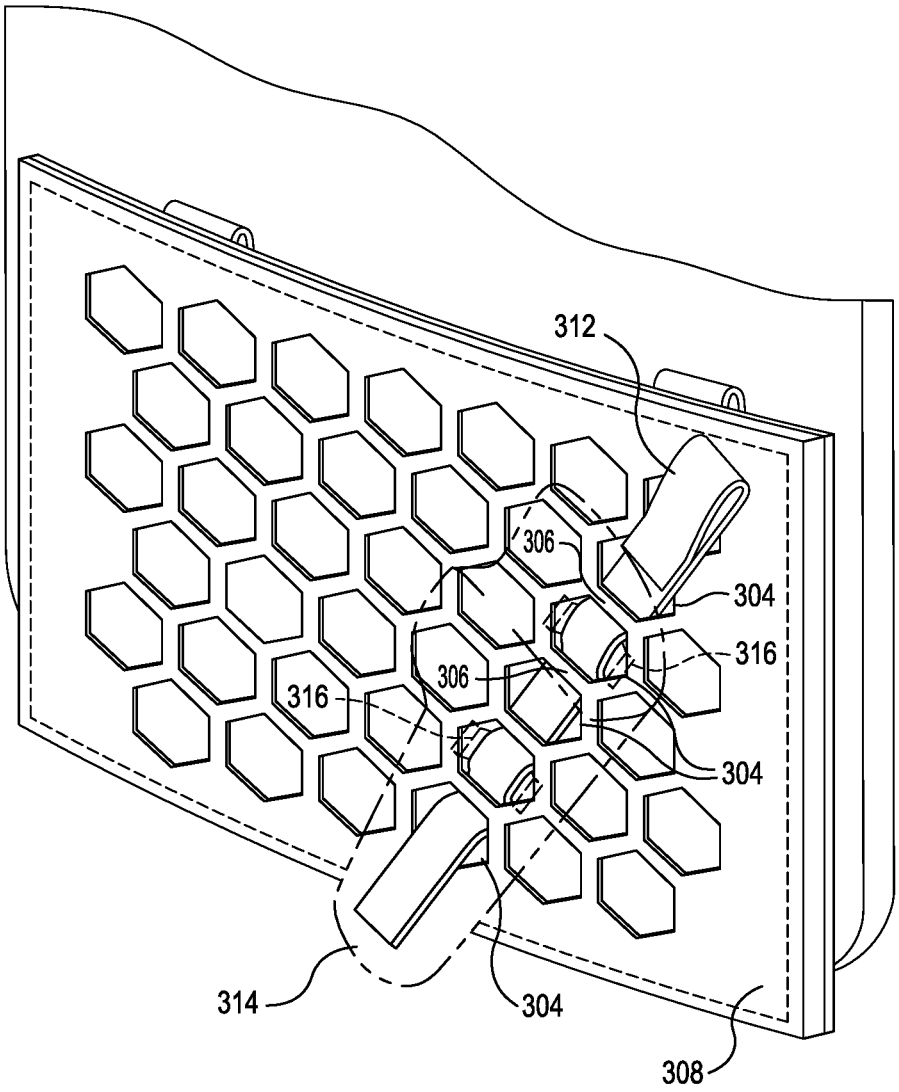
FIG. 4 illustrates equipment mounted to the hexagonal attachment system according to an embodiment.

FIG. 3 also illustrates an example of how a piece of equipment or gear—such as holster 314—can be attached via the hexagonal attachment system 302. FIG. 4 further illustrates the holster 314 attached. An attachment member 312 can be routed along an axis 318 (FIG. 3) through a plurality of openings 304 in an attachment platform 308. The attachment member 312 can interact with features of the holster 314, such as loops 316, to hold the holster 314 in place with respect to the attachment platform 308. Although the attachment member 312 is depicted as a piece separate from the holster 314 in FIGS. 3 and 4, the attachment member 312 may include any suitable attachment mechanism, including a hook on the holster 314 or an attachment member 312 that is otherwise secured to the holster 314, such as by stitching or snaps.

Figure 5:
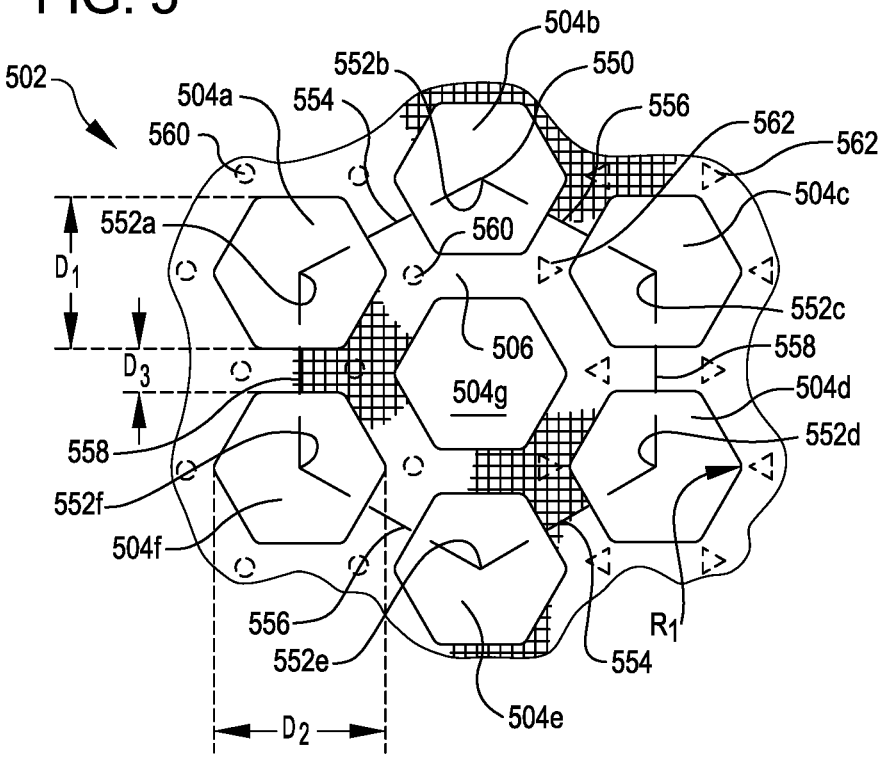
FIG. 5 illustrates an arrangement of openings of the hexagonal attachment system according to an embodiment.
Figure 6:
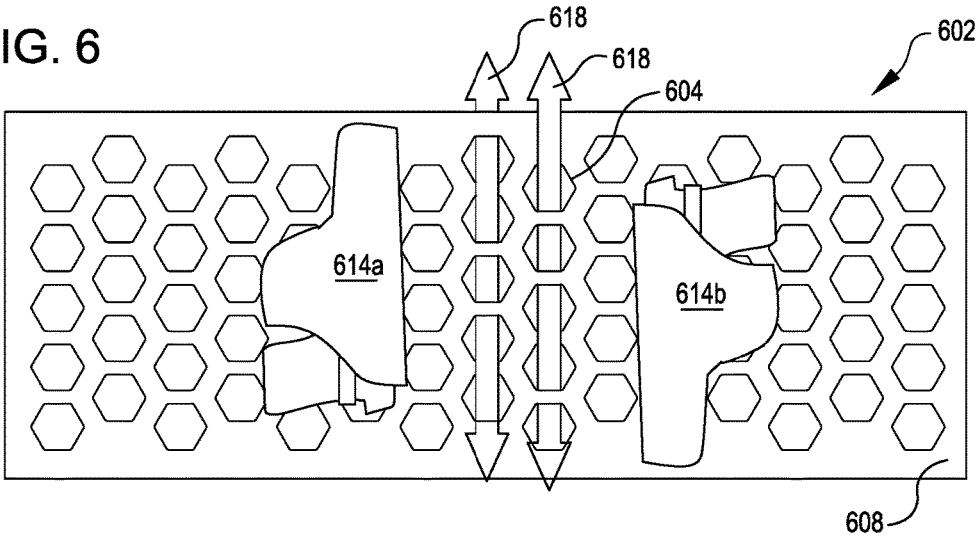
FIGS. 6 through 11 illustrate examples of orientations at which equipment can be mounted via a hexagonal attachment system according to embodiments.

FIG. 5 illustrates an arrangement of openings 504 (e.g., first through seventh openings **504*a*-504*g*) for a hexagonal attachment system 502** in accordance with embodiments.

The openings 504 can be hexagonally-shaped. However, the openings 504 are not limited to a hexagonal shape and may be any suitable shape, including round, circular, or polygonal. The openings 504 may be arranged so as to resemble a honeycomb pattern. The openings 504 may be arranged in patterns having other distinguishing features. For example, the openings 504 may form a pattern of overlapping adjacent columns. The openings 504 may form a pattern in which at least one hexagonal opening 504*g* from the plurality of hexagonal openings 504*a*-504*g* is positioned such that each side of the hexagonal opening 504*g* is adjacent to a parallel side of another hexagonal opening 504*a*-504*f* of the plurality of hexagonal openings 504*a*-504*g*. The openings 504 may form a staggered pattern.

The openings 504 can be separated by a plurality of interconnected links 506. Each link 506 may extend along and between adjacent sides of a pair of adjacent openings 504. For example, a link 506 may extend along and between adjacent sides of a pair of adjacent hexagonally-shaped openings 504*g* and 504*b*. Each link 506 may join at least one other link 506 near corners of adjacent openings 504.

The openings 504 may form a hexagonal pattern. For example, the openings 504 may be arranged in a pattern corresponding to a hexagon 550. As an illustrative example, the openings 504*a*-504*f* depicted in FIG. 5 are arranged such that a center of each opening 504*a*-504*f* is positioned at a respective corner 552*a*-552*f* of the hexagon 550 (although in some embodiments, the hexagon 550 may instead be demarcated by corners 552*a*-552*f* that correspond to akin edges or other features of the openings 504 other than the centers). Further openings 504 may also be present, such as the seventh opening 504*g* depicted in the center of the hexagon 550 or other openings 504 beyond the periphery of the hexagon 550 (not shown in FIG. 5, but may be appreciated with reference to FIGS. 6-11).

The hexagon 550 may be a regular hexagon. The hexagon 550 may have a first pair of parallel sides 554, a second pair of parallel sides 556, and a third pair of parallel sides 558. The openings 504 may be arranged to allow an attachment member (such as the attachment member 312 depicted in FIGS. 3 and 4) to pass through multiple of the openings 504 in any direction parallel or perpendicular to any of the pairs of parallel sides 554, 556, 558. As illustrative examples of such parallel directions, an attachment member may be oriented parallel to the parallel sides 554 (e.g., passing through first opening 504*a* and second opening 504*b;* or passing through sixth opening 504*f,* seventh opening 504*g,* and third opening 504*c;* or passing through fourth opening 504*d* and fifth opening 504*e*), parallel to the parallel sides 556 (e.g., passing through second opening 504*b* and third opening 504*c;* or passing through first opening 504*a,* seventh opening 504*g,* and fourth opening 504*d;* or passing through fifth opening 504*e* and sixth opening 504*f*), or parallel to the parallel sides 558 (e.g., passing through sixth opening 504*f* and first opening 504*a;* or passing through fifth opening 504*e,* seventh opening 504*g,* and second opening 504*b;* or passing through fourth opening 504*d* and third opening 504*c*). As illustrative examples of such perpendicular directions, an attachment member may be oriented perpendicular to the parallel sides 554 (e.g., passing through first opening 504*a* and fifth opening 504*e;* or passing through fourth opening 504*d* and second opening 504*b*), perpendicular to the parallel sides 556 (e.g., passing through fifth opening 504*e* and third opening 504*c;* or passing through second opening 504*b* and sixth opening 504*f*), or perpendicular to the parallel sides 558 (e.g., passing through sixth opening 504*f* and fourth opening 504*d;* or passing through third opening 504*c* and first opening 504*a*).

In some aspects, the openings 504 can have uniform dimensions. A side-to-side width can correspond to a distance between two parallel sides of the hexagonal opening 504, as denoted by D1 in FIG. 5. The side-to-side width may be wider than a width of an attachment member (such as the attachment member 312 depicted in FIGS. 3 and 4) so as to facilitate weaving the attachment member in a direction parallel to the two parallel sides of the hexagonally-shaped opening. A corner-to-corner width can correspond to a distance between two corners positioned on opposite ends of a hexagonal opening 504 along a bisecting axis of the hexagonal opening 504, as denoted D2 in FIG. 5. The corner-to-corner may be wider than a width of an attachment member so as to facilitate weaving in a direction perpendicular to the bisecting axis. Corners of a hexagonal opening can have a defined inner radius, such as denoted as R1 in FIG. 5. Such rounded corners can reduce a sharpness of a transition between adjacent edges of a hexagonal opening 504 and reduce a likelihood of tearing at the corner. A link width, such as denoted as D3 in FIG. 5, can indicate a width of a link 506 separating parallel sides of adjacent hexagonal openings 504. The openings 504 may be sized to accommodate attachment members that are compatible with MOLLE systems and/or attachment members that are different. Providing a hexagonal attachment system 502 dimensioned to be compatible with MOLLE-compatible gear can allow owners of existing MOLLE-compatible gear to utilize the hexagonal attachment system 502 without replacing such gear. For example, in a particular embodiment, the arrangement of openings 504 may include a side-to-side width D1 of 1 inch (2.54 centimeters), a corner-to-corner width D2 of 1.14 inch (2.896 centimeters), an inner radius R1 of 0.25 inch (0.635 centimeter) inch, and/or a link width D3 of 0.32 inch (0.8128 centimeter). A corner-to-corner width D2 of 1.14 inch (2.896 centimeters) can permit passage of a typical MOLLE-compatible attachment member (e.g., commonly 1 inch wide (2.54 centimeters)) to pass through openings 504 in any direction parallel to any parallel sides 554, 556, 558 of the hexagon 550 for attaching MOLLE-compatible gear by the hexagonal attachment system 502. A side-to-side width D1 of 1 inch (2.54 centimeters) can permit passage of a more slender attachment member (e.g., 0.5 inches wide (1.27 centimeters)) to pass through openings 504 in any direction perpendicular and/or parallel to any parallel sides 554, 556, 558 of the hexagon 550 for attaching MOLLE-compatible gear by the hexagonal attachment system 502. An inner radius R1 of 0.25 inch (0.635 centimeter) may improve durability or reduce a rate of wear or tearing of the hexagonal attachment system 502. A link width D3 of 0.32 inch (0.8128 centimeter) may provide sufficient load-bearing strength for the links 506 to support attached gear.

FIG. 6-11 illustrate a variety of orientations at which equipment can be mounted via a hexagonal attachment system 602. The variety of orientations possible can permit equipment to be attached at a certain position and orientation so as to facilitate ease of access at a time of use. As may be appreciated by reference to FIG. 6-11, by virtue of using a hexagonal arrangement of openings, equipment can be attached at any orientation corresponding to an hour of the clock. For example, in FIG. 6, a holster 614*a* can be mounted pointing upward towards the 12 o'clock direction or a holster 614*b* can be mounted pointing downward toward a 6 o'clock direction. An attachment member (such as the attachment member 312 depicted in FIGS. 3 and 4) routed along an axis 618 through openings 604 in the attachment platform 608 may facilitate such attached orientations of either holster 614*a* or 614*b*. The axis 618 may correspond to a direction parallel to a side of the hexagon 550 described with respect to FIG. 5.

Figure 7:
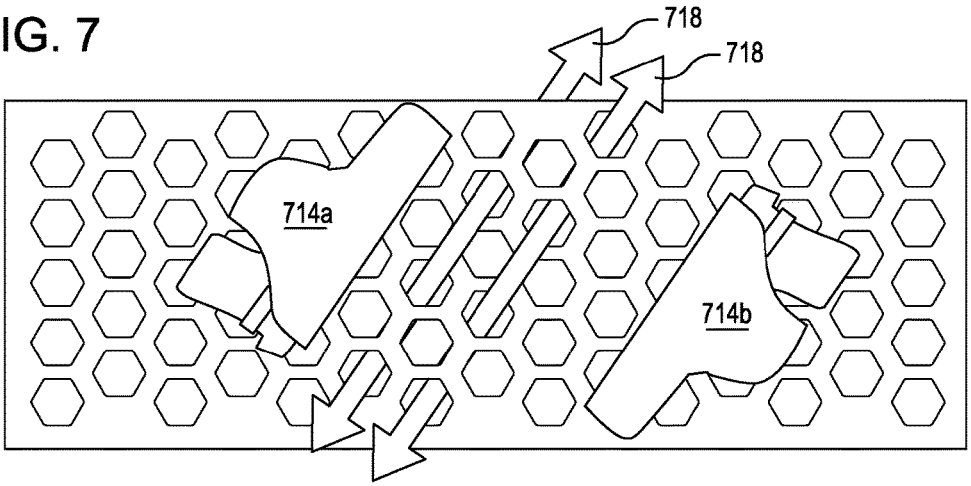

As illustrated in FIG. 7, routing an attachment member along an axis 718 (e.g., in a direction perpendicular to a side of the hexagon 550 described with respect to FIG. 5) can facilitate mounting a holster 714*a* pointed toward a 1 o'clock direction and/or mounting a holster 714*b* pointing in a 7 o'clock direction.

Figure 8:
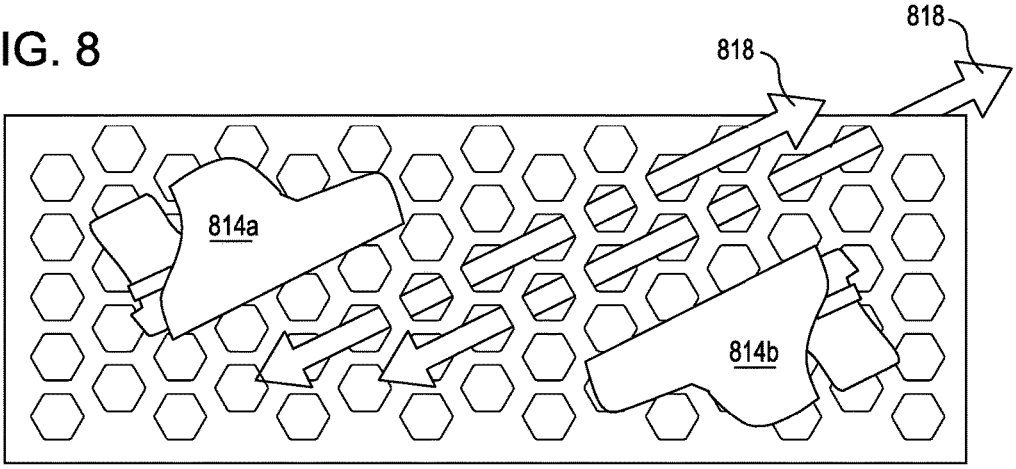

As illustrated in FIG. 8, routing an attachment member along an axis 818 (e.g., in a direction parallel to a side of the hexagon 550 described with respect to FIG. 5) can facilitate mounting a holster 814*a* pointed toward a 2 o'clock direction and/or mounting a holster 814*b* pointing in an 8 o'clock direction.

Figure 9:
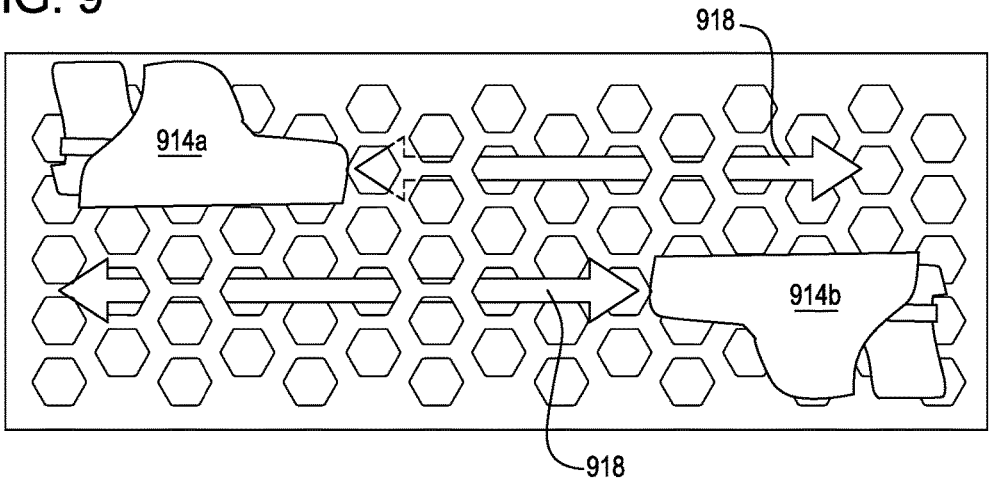

As illustrated in FIG. 9, routing an attachment member along an axis 918 (e.g., in a direction perpendicular to a side of the hexagon 550 described with respect to FIG. 5) can facilitate mounting a holster 914*a* pointed toward a 3 o'clock direction and/or mounting a holster 914*b* pointing in a 9 o'clock direction.

Figure 10:
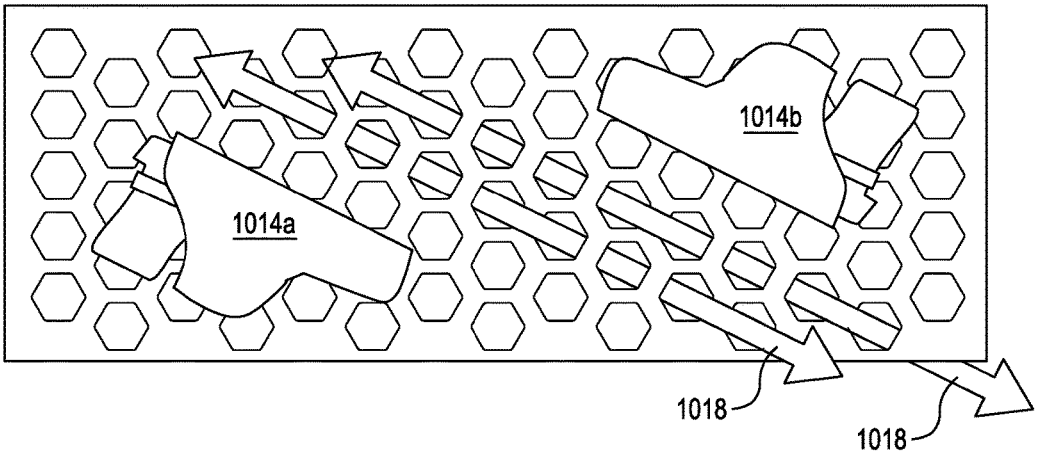

As illustrated in FIG. 10, routing an attachment member along an axis 1018 (e.g., in a direction parallel to a side of the hexagon 550 described with respect to FIG. 5) can facilitate mounting a holster 1014*a* pointed toward a 4 o'clock direction and/or mounting a holster 1014*b* pointing in a 10 o'clock direction.

Figure 11:
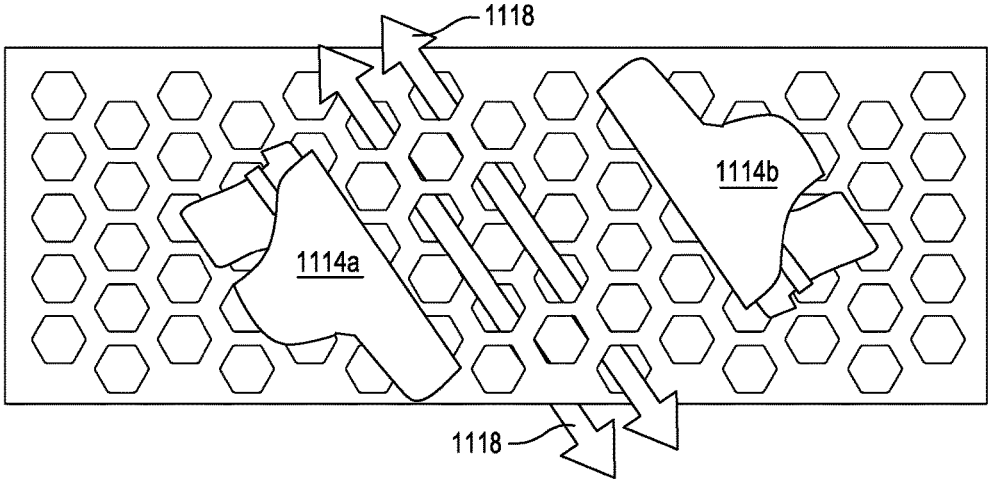

As illustrated in FIG. 11, routing an attachment member along an axis 1118 (e.g., in a direction perpendicular to a side of the hexagon 550 described with respect to FIG. 5) can facilitate mounting a holster 1114*a* pointed toward a 5 o'clock direction and/or mounting a holster 1114*b* pointing in a 11 o'clock direction.

As may be appreciated with reference to various of the previously discussed figures, an attachment member (such as the attachment member 312 depicted in FIGS. 3 and 4) may be weaved in any suitable manner to secure gear to an attachment platform. For example, as illustrated in FIG. 4, an attachment member 312 may pass through an opening 304, through an attachment feature of gear (such as loop 316 of holster 314), and back through the same opening 304 without weaving over a link 306 in the process. In some aspects, an attachment member may be weaved alternatingly over and under consecutive links, such as may be appreciated with reference to the axes 718 depicted in FIG. 7. In some aspects, attachment members may be weaved so as to pass over or under two or more links at a time, such as may be appreciated with reference to the axes 818 depicted in FIG. 8.

As may be appreciated with reference to various of the previously discussed figures, a hexagonal attachment system can include a number of connections for securing an attachment platform to a backing structure. For example, links 206 may be secured between openings 204 of the attachment platform 208 with the backing structure 210 described above with respect to FIG. 2. Non-limiting examples of such connections include the round (e.g., circular) stitch-downs 560 or the triangular stitch-downs 562 depicted in FIG. 5. The triangular stitch downs 562 may be triangular in shape and may be arranged so that each corner of the triangular stitch-down 562 is directed at a proximate corner of a hexagonal opening 504. In some embodiments, a round stitch-down 560 may be less complex and/or smaller than a triangular stitch-down 562 and yet still provide adequate support for the attachment platform.

Although including connections such as stitch downs 560 or 562 may improve stability, the connections between openings 504 may also limit the number of directions in which an attachment member (such as the attachment member 312 depicted in FIGS. 3 and 4) may be routed to attach gear via the hexagonal attachment system 502. For example, in the arrangement depicted in FIG. 5, the connections such as stitch downs 560 or 562 may prevent the member from passing in a direction along a length of a link 506 (such as between first opening 504*a* and third opening 504*c*) while still permitting passage of the member in a direction across a width of the link 506 (such as between seventh opening 504*g* and second opening 504*b*).

Furthermore, although the connections are depicted in FIG. 5 as a combination of round stitch-downs 560 and triangular stitch-downs 562, the connections may alternatively or additionally include all round stitch-downs 560, all triangular stitch-downs 562, or other forms of connections including bonding, fusing, other stitching, grommets, and/or snaps. Snaps may provide detachable connections, thereby selectively providing additional support when desired, yet maintaining the functionality of being able to pass attachment members in other directions that would be blocked by the connections if in place.

As may be appreciated with reference to various of the previously discussed figures, arrangements of hexagonally shaped openings may differ as to an orientation of hexagonally shaped openings relative to a top side of an attachment platform. For example, as may be appreciated with reference to FIG. 4, in some aspects, a corner of a hexagonally shaped opening 304 faces a top side of an attachment platform 308. In a contrasting example that may be appreciated with reference to FIG. 6, a flat side of a hexagonally shaped opening 604 may face a top side of an attachment platform 608. In some aspects, as is the case with respect to these two examples of FIG. 4 and FIG. 6, one extreme orientation may be attained by rotating the other extreme orientation by 90 degrees. In some aspects, an attachment platform may include an arrangement of hexagonally shaped openings that are arranged at a skewed orientation falling between the extremes described and depicted with respect to FIGS. 4 and 6.

Rotating between one extreme orientation and another may alter which directions are blocked by a set of connections (such as stitch downs 560 and 562 depicted in FIG. 5). For example, the arrangement of stitch downs 560 and 562 depicted in FIG. 5 may permit the routing of an attachment member along axes corresponding to the 12 o'clock, 2 o'clock, and 4 o'clock directions relative to a vest (e.g., directions shown in FIGS. 6, 8, and 10), while preventing routing along axes of the 1 o'clock, 3 o'clock, and 5 o'clock directions (e.g., directions shown in FIGS. 7, 9, and 11). However, if the arrangement of stitch downs 560 and 562 depicted in FIG. 5 is rotated by 90 degrees (e.g., so that corners instead of flat sides of the hexagonal openings 504 face upward), the rotated arrangement may instead permit the routing of an attachment member along axes corresponding to the 1 o'clock, 3 o'clock, and 5 o'clock directions relative to a vest (e.g., directions shown in FIGS. 7, 9, and 11), while preventing routing along axes of the 12 o'clock, 2 o'clock, and 4 o'clock directions (e.g., directions shown in FIGS. 6, 8, and 10).

The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

All references, including publications, patent applications and patents, cited herein or in any contemporaneously filed Information Disclosure Statements are hereby incorporated by reference to the same extent as if each reference were individually and specifically indicated to be incorporated by reference and were set forth in its entirety herein.

What is claimed is:

1. An assembly comprising:

an item;

a load-bearing platform connected with or comprising at least a portion of the item; and a substrate comprising:

a) an attachment platform connected with the load-bearing platform; and b) a plurality of openings formed in the attachment platform and arranged in a repeating hexagonal pattern configured to facilitate attachment of MOLLE-compatible accessories to the attachment platform along any of at least three differing axes, wherein at least one of the openings of the plurality of openings is hexagonally-shaped and has a side-to-side width corresponding to a distance between two parallel sides of said hexagonally-shaped opening, and wherein said side-to-side width is wider than a member width corresponding to a width of an attachment member for a MOLLE-compatible accessory so as to facilitate inserting the attachment member through said hexagonally-shaped opening in a direction parallel to said two parallel sides of said hexagonally-shaped opening to attach said MOLLE-compatible accessory.

2. The assembly of claim 1, wherein the item comprises at least one of clothing, a garment, pants, a shirt, a jacket, a vest, a girdle, a pack, a pouch, a holster, a sheath, an ammunition clip, or accessory thereof.

3. The assembly of claim 1, wherein the repeating hexagonal pattern corresponds to a hexagon that is a regular hexagon.

4. The assembly of claim 1, wherein the repeating hexagonal pattern corresponds to a hexagon, wherein the plurality of openings are arranged in a pattern to receive the attachment member for the MOLLE-compatible accessory through multiple openings of the plurality of openings in a direction parallel to a side of the hexagon.

5. The assembly of claim 1, wherein the repeating hexagonal pattern corresponds to a hexagon, wherein the plurality of openings are arranged in a pattern to receive the attachment member for the MOLLE-compatible accessory through multiple openings of the plurality of openings in a direction perpendicular to a side of the hexagon.

6. The assembly of claim 1, wherein the repeating hexagonal pattern corresponds to a hexagon, wherein the plurality of openings are arranged in a pattern to receive the attachment member for the MOLLE-compatible accessory through multiple openings along any of:

a first axis perpendicular to a first set of parallel sides of the hexagon, a second axis perpendicular to a second set of parallel sides of the hexagon, a third axis perpendicular to a third set of parallel sides of the hexagon, a fourth axis parallel to the first set of parallel sides of the hexagon, a fifth axis parallel to the second set of parallel sides of the hexagon, or a sixth axis parallel to the third set of parallel sides of the hexagon.

7. The assembly of claim 1, further comprising the MOLLE-compatible accessory.

8. An assembly comprising:

an item;

a load-bearing platform connected with or comprising at least a portion of the item; and a substrate comprising:

a) an attachment platform connected with the load-bearing platform; and b) a plurality of openings formed in the attachment platform and arranged in a repeating hexagonal pattern configured to facilitate attachment of MOLLE-compatible accessories to the attachment platform along any of at least three differing axes, wherein at least one of the openings of the plurality of openings is hexagonally-shaped and has a corner-to-corner width corresponding to a distance between two corners positioned on opposite ends of a bisecting axis of said hexagonal opening, and wherein said corner-to-corner width is wider than a member width corresponding to a width of an attachment member for a MOLLE-compatible accessory so as to facilitate inserting the attachment member through said hexagonally-shaped opening in a direction perpendicular to the bisecting axis to attach said MOLLE-compatible accessory.

9. The assembly of claim 8, wherein the item comprises at least one of clothing, a garment, pants, a shirt, a jacket, a vest, a girdle, a pack, a pouch, a holster, a sheath, an ammunition clip, or accessory thereof.

10. The assembly of claim 8, wherein the repeating hexagonal pattern corresponds to a hexagon that is a regular hexagon.

11. The assembly of claim 8, wherein the repeating hexagonal pattern corresponds to a hexagon, wherein the plurality of openings are arranged in a pattern to receive the attachment member for the MOLLE-compatible accessory through multiple openings of the plurality of openings in a direction parallel to a side of the hexagon.

12. The assembly of claim 8, wherein the repeating hexagonal pattern corresponds to a hexagon, wherein the plurality of openings are arranged in a pattern to receive the attachment member for the MOLLE-compatible accessory through multiple openings of the plurality of openings in a direction perpendicular to a side of the hexagon.

13. The assembly of claim 8, wherein the repeating hexagonal pattern corresponds to a hexagon, wherein the plurality of openings are arranged in a pattern to receive the attachment member for the MOLLE-compatible accessory through multiple openings along any of:

a first axis perpendicular to a first set of parallel sides of the hexagon, a second axis perpendicular to a second set of parallel sides of the hexagon, a third axis perpendicular to a third set of parallel sides of the hexagon, a fourth axis parallel to the first set of parallel sides of the hexagon, a fifth axis parallel to the second set of parallel sides of the hexagon, or a sixth axis parallel to the third set of parallel sides of the hexagon.

14. The assembly of claim 8, further comprising the MOLLE-compatible accessory.

15. An assembly comprising:

an item;

a load-bearing platform connected with or comprising at least a portion of the item; and a substrate comprising:

a) an attachment platform connected with the load-bearing platform; and b) a plurality of openings formed in the attachment platform and arranged in a repeating hexagonal pattern configured to facilitate attachment of MOLLE-compatible accessories to the attachment platform along any of at least three differing axes, wherein the plurality of openings comprises a plurality of hexagonal openings separated by a plurality of interconnected links extending along and between adjacent sides of adjacent hexagonal openings, each hexagonal opening having a side-to-side width corresponding to a distance between two parallel sides of said hexagonal opening and a corner-to-corner width corresponding to a distance between two corners positioned on opposite ends of a bisecting axis of said hexagonal opening, said side-to-side width being approximately 1 inch (2.54 centimeters), said corner-to-corner width being approximately 1.14 inches (2.896 centimeters), each of said hexagonal openings having corners each with a defined inner radius of approximately 0.25 inches (0.635 centimeter), and each of said links having a width of approximately 0.32 inches (0.8128 centimeter) between adjacent sides of adjacent hexagonal openings.

16. The assembly of claim 15, wherein the item comprises at least one of clothing, a garment, pants, a shirt, a jacket, a vest, a girdle, a pack, a pouch, a holster, a sheath, an ammunition clip, or accessory thereof.

17. The assembly of claim 15, wherein the repeating hexagonal pattern corresponds to a hexagon, wherein the plurality of openings are arranged in a pattern to receive an attachment member for a MOLLE-compatible accessory through multiple openings of the plurality of openings in a direction parallel to a side of the hexagon.

18. The assembly of claim 15, wherein the repeating hexagonal pattern corresponds to a hexagon, wherein the plurality of openings are arranged in a pattern to receive an attachment member for a MOLLE-compatible accessory through multiple openings of the plurality of openings in a direction perpendicular to a side of the hexagon.

19. The assembly of claim 15, wherein the repeating hexagonal pattern corresponds to a hexagon, wherein the plurality of openings are arranged in a pattern to receive an attachment member for a MOLLE-compatible accessory through multiple openings along any of:

a first axis perpendicular to a first set of parallel sides of the hexagon, a second axis perpendicular to a second set of parallel sides of the hexagon, a third axis perpendicular to a third set of parallel sides of the hexagon, a fourth axis parallel to the first set of parallel sides of the hexagon, a fifth axis parallel to the second set of parallel sides of the hexagon, or a sixth axis parallel to the third set of parallel sides of the hexagon.

20. The assembly of claim 15, further comprising the MOLLE-compatible accessory.

* * * * *